United States Patent [19]

Shull et al.

[11] Patent Number: 4,771,255

[45] Date of Patent: Sep. 13, 1988

[54] SOLENOID WITH A MECHANICAL LOCKING LINKAGE

[75] Inventors: Daniel S. Shull, Raleigh, N.C.; Lester P. Henley, Stickney, Ill.

[73] Assignee: Regdon Solenoid, Inc., Brookfield, Ill.

[21] Appl. No.: 158

[22] Filed: Jan. 2, 1987

[51] Int. Cl.[4] ..... H01F 7/08

[52] U.S. Cl. ..... 335/253; 335/169

[58] Field of Search ..... 335/167, 168, 169, 170, 335/253, 254

[56] References Cited

U.S. PATENT DOCUMENTS

| | | | |
|---|---|---|---|
| 2,149,059 | 5/1938 | Leon | 135/74 |
| 2,448,959 | 9/1948 | Conlan | 335/253 |
| 2,845,804 | 8/1958 | Lambert | 74/110 |
| 3,307,131 | 2/1967 | Hook et al. | 335/253 |
| 3,792,391 | 2/1974 | Ewing | 335/254 |

FOREIGN PATENT DOCUMENTS

| | | | |
|---|---|---|---|
| 1175892 | 4/1959 | France | 335/253 |
| 844337 | 8/1960 | United Kingdom | 335/253 |

*Primary Examiner*—George Harris

*Attorney, Agent, or Firm*—Neuman, Williams, Anderson & Olson

[57] ABSTRACT

A solenoid device is provided which includes a bobbin having an armature bore through its center; a plunger partially extending into the bore and serving as an armature of the solenoid; and a coil wound around the bobbin for generating magnetic flux to move the plunger axially in the bore. The plunger includes a first segment which moves axially in the bore of the bobbin in response to magnetic flux generated by the coil. The plunger also includes a second segment which serves as the latching device for the locking mechanism. Finally, the plunger includes a linkage connecting the first and second segments together and mounting devices for mounting the linkage to the first and second segments. This linkage pivots in response to a compressive force applied to the plunger and engages a stop disposed proximate the plunger, preventing the second segment from moving out of a latching position.

12 Claims, 2 Drawing Sheets

FIG. 1
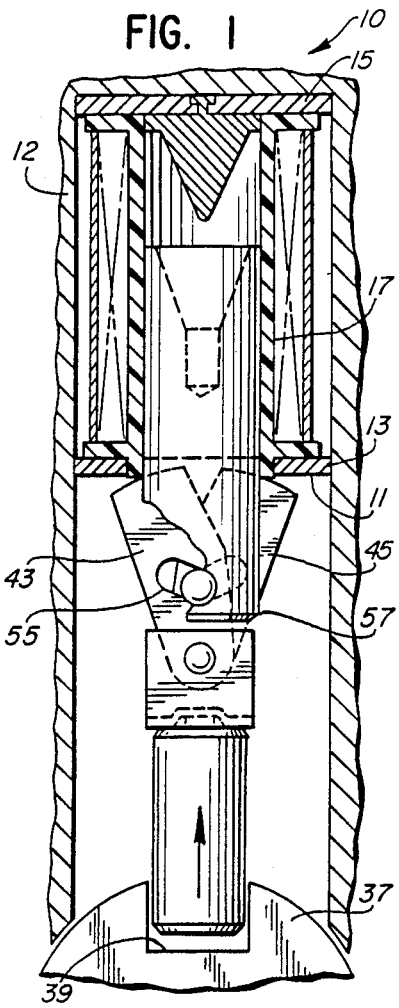
FIG. 2
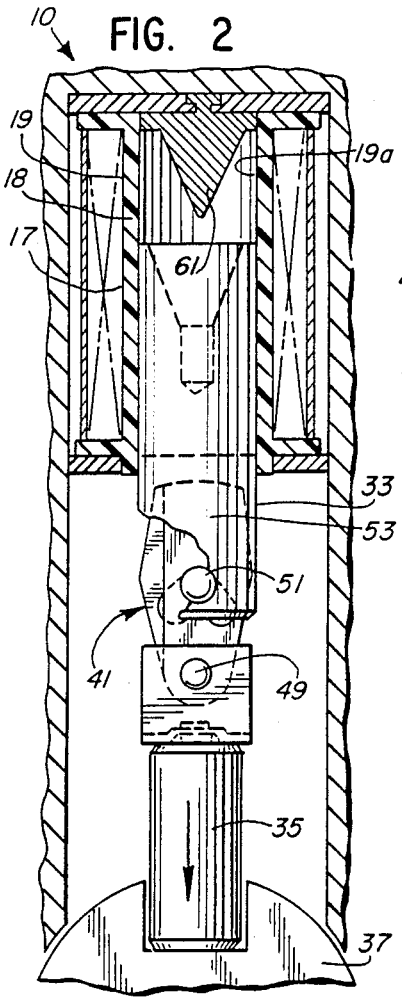
FIG. 3
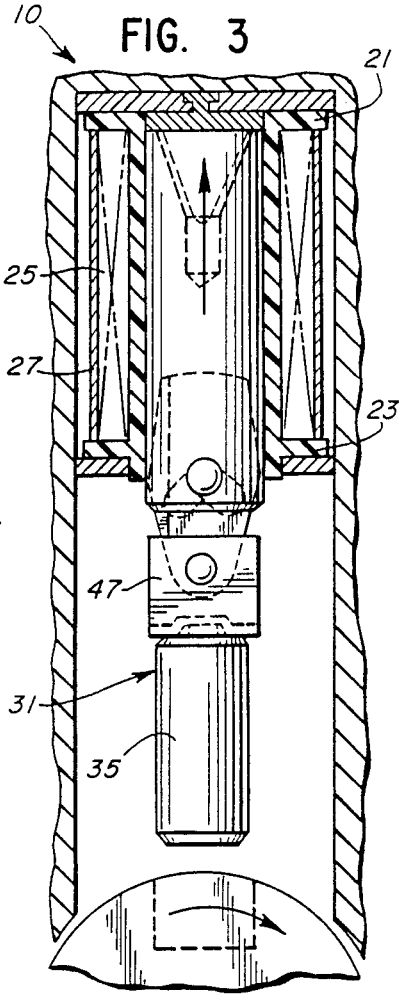
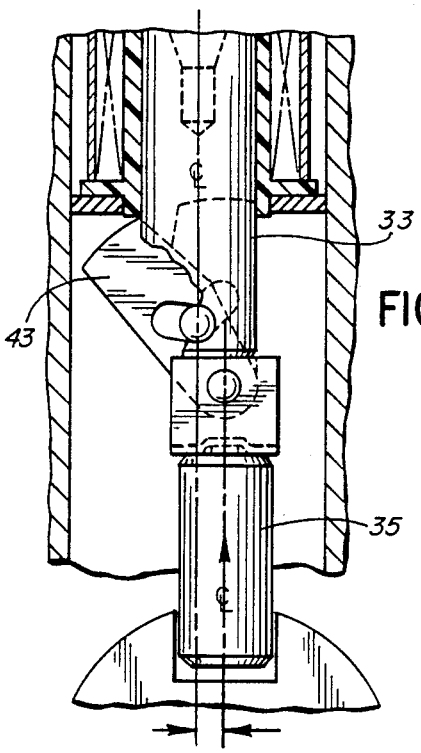
FIG. 4
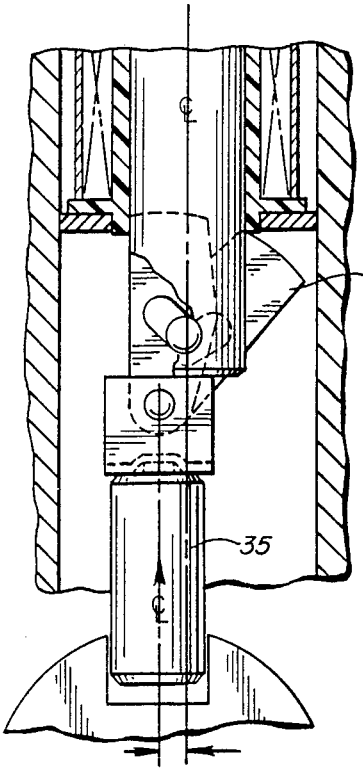
FIG. 5

SOLENOID WITH A MECHANICAL LOCKING LINKAGE

BACKGROUND OF THE INVENTION

1. Field of the Invention

The present invention relates to an electromagnetic actuator with a mechanical locking linkage and more particularly to an electromagnetic actuator with a mechanical locking linkage which prevents unintended movement of the actuator plunger into the well of the actuator.

2. Description of the Prior Art

Electromagnetic actuators convert electrical impulses into mechanical action and perform many functions. Specifically, in one application an electromagnetic actuator performs the latching and unlatching function in a locking mechanism. In such an application, the plunger of the electromagnetic actuator typically serves as a latching member which engages a corresponding member to secure the door or other movable structure used to close an opening.

The plunger of the solenoid device in this application moves along a generally vertical axis. It rises out of locking engagement under the force of magnetic flux generated by the actuator coil when the user energizes the coil. Upon removal of the power input, it drops, under the force of gravity, into locking engagement.

Maintaining the plunger in the raised position requires continuous energizing of the actuator. However, unlatching the locking device requires that the solenoid raise the plunger and maintain it in the raised position only a relatively short time duration. Thus, the user need only pulse the solenoid, minimizing the energy used by the solenoid.

Typically, the plunger lies in the lower position, i.e. in locking engagement, for a substantially longer time duration. To conserve energy, the locking mechanism relies on the weight on the plunger to maintain it in the lower position. But for this application, as well as most other applications, the plunger cannot have an excessive weight or size.

Due to the size and weight limitations, the actuators used in this application suffer a severe disadvantage where security is an important consideration. They cannot prevent tampering. A blow applied to the locking mechanism and directed so that it lifts the plunger allows unlatching of the locking mechanism.

The solenoid device of the present invention provides a mechanical linkage which allows the user to move the solenoid armature in and out of locking engagement; and it prevents tampering and unintended movement of the armature out of locking engagement. It provides a construction which minimizes the expense of manufacturer and assembly and gives precise, uniform and reliable performance. The solenoid device of the present invention comprises a small number of components with sufficiently accurate and consistent tolerances. These components produce the requisite mechanical action and place the armature in proper position and alignment yet prevent tampering or any undesired movement of the armature.

OBJECTS OF THE INVENTION

It is a general object of the present invention to provide an improved solenoid device.

It is a more specific object of this invention to provide an improved solenoid device for a locking mechanism which overcomes the disadvantages of the prior art.

It is another object of the present invention to provide an improved solenoid device with a construction which minimizes the expense of manufacture and assembly and gives precise uniform and reliable performance.

It is yet another object of this invention to provide a solenoid device for a locking mechanism, including a linkage which prevents undesired movement of the armature.

It is still another object of the present invention to provide an improved solenoid device for a locking mechanism with an armature which prevents tampering with the locking mechanism.

Other objects, advantages and features of the present invention will become apparent upon reading the following detailed description and appended claims and upon reference to the accompanying drawings.

SUMMARY OF THE INVENTION

In accordance with the two illustrated embodiments of this invention, a solenoid device which achieves the foregoing objects generally includes a one piece integrally molded bobbin unit with an armature bore through its center, a plunger which extends partially into the bore and serves as an armature of the solenoid, and a coil wound around the bobbin for generating magnetic flux to move the plunger axially in the bore of the bobbin.

The plunger includes a first segment formed out of material having a high magnetic permeability. This first segment moves axially in the bore under the magnetic flux generated by the coil. The plunger also includes a second segment disposed outward of the first segment. In the illustrated embodiments this second segment serves as a latch member for a locking mechanism. Finally, the plunger includes a linkage disposed between the first and second segments. This linkage connects the first and second segments together. It also responds to compressive forces applied to the plunger by extending transversely and outwardly of the first segment to engage a stop disposed proximate the plunger. In doing so, it prevents the second segment of the plunger from moving out of its latching position in the locking mechanism.

In the first illustrated construction, the linkage includes two wing members pivotally mounted to the second segment and slideably secured to the first segment. These segments remain in a closed position when an axial tension force acts on the plunger i.e. a magnetic force which pulls the first segment upward into the bore and the gravitational force which pulls the plunger downward. Upon application of a compressive force while the plunger lies extended, however, these wing members pivot outward to engage a stop disposed proximate the plunger. In this construction the stop is a portion of solenoid bobbin circumjacent the bore.

In the first illustrated embodiment, the linkage includes two wing members to compensate for axial misalignment between the first and second segments. When the longitudinal axes of these two segments are not collinear, one of the two wing members pivots transversely and outwardly of the first segment a greater extent than the other wing.

Alternatively, in accordance with a second illustrated embodiment the solenoid plunger has a linkage which includes one pivoting wing member, and a first plunger segment with a hexagonal cross-section. The solenoid bobbin has a bore with a corresponding hexagonal cross-section to prevent rotation of the first segment and maintain the alignment between the first and second segments.

During operation of the improved solenoid device, application of a voltage to the coil produces a flux within the core of the bobbin which moves the first segment of the plunger into the bore. Removal of voltage from the coil causes the flux to decrease, thereby reducing the magnetic force on the first segment of the plunger. The plunger usually lies along a vertical axis whereby upon removal of the voltage the force of gravity acts on it to move it downward to a point where the second segment engages a corresponding member of a locking mechanism. Upon application of a compressive force to the plunger, the linkage which connects the first and second segments pivots outward of the first segment to engage a stop disposed proximate the plunger. In doing so, it prevents the plunger from moving further into the bore of the bobbin and, accordingly, the second segment from moving out of latching its latching position in the locking mechanism.

BRIEF DESCRIPTION OF THE DRAWINGS

For a more complete understanding of this invention one should now refer to the embodiment illustrated in greater detail in the accompanying drawings and described below by way of an example of the invention. In the drawings:

FIG. 1 is a sectional view of a first embodiment of the solenoid device embodying the present invention. The figure shows the plunger linkage in an extended position, the position to which it moves upon application of a compressive or upward force on the plunger.

FIG. 2 is a sectional view of the embodiment of FIG. 1, showing the plunger in locking engagement after removal of the voltage from the solenoid coil but before the plunger has come to rest. In the "at rest" position, the plunger linkage moves generally to the position shown in FIG. 1 in response to a compression force created by the weight of the first segment and the reaction force from the surface upon which the second segment rests.

FIG. 3 is a section view of the embodiment of FIG. 1, showing the plunger after application of a voltage to the coil producing a flux within the bore or the bobbin to move the plunger into the raised position shown.

FIG. 4 is a partial sectional view of the solenoid device, showing the position to which the plunger linkage moves in response to a compressive force when the longitudinal axis of the second segment lies to the right of the longitudinal axis of the first segment.

FIG. 5 is a partial sectional view of the solenoid device, showing the position to which the plunger linkage moves in response to a compressive force when the longitudinal axis of the second segment lies to the left of the longitudinal axis of the first segment.

Figure 7:
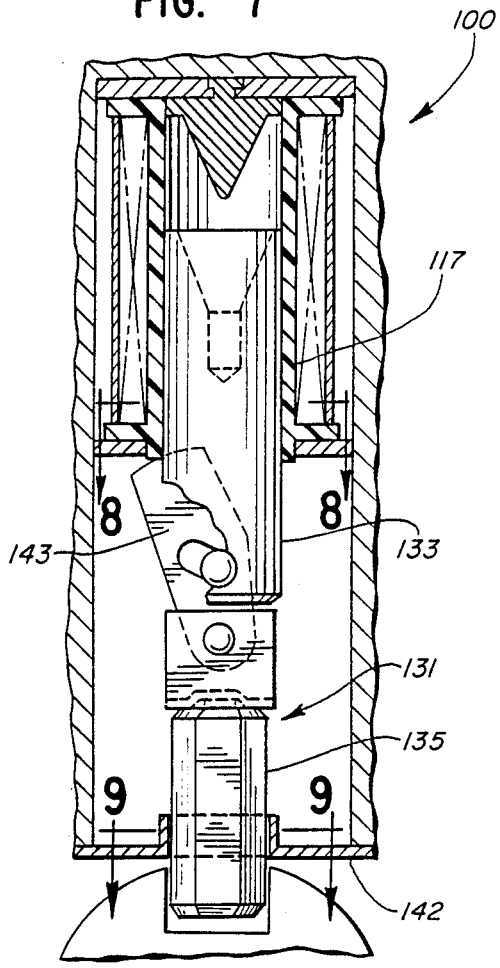
FIG. 7 is a sectional view of an alternative embodiment of the solenoid device of the present invention.

While the following text describes the invention in connection with two embodiments, one should understand that the invention is not limited to these embodiments. Furthermore, one should understand that the drawings are not necessarily to scale and that they illustrate these embodiments, in part, by graphic symbols, diagramatic representations and fragmentary views. In certain instances, the drawings do not include details which are not necessary for an understanding of the present invention.

DETAILED DESCRIPTION OF THE DRAWINGS AND OF THE EMBODIMENTS

Turning now to the drawings, FIGS. 1 through 5 show the solenoid device of the present invention generally at 10. The solenoid includes a base 11 for mounting the solenoid to a supporting member 12. This base 11 is a flat, elongated metal plate bent into a U-shape having two side flanges 13 and 15 and a bottom, connecting portion (not shown). The flanges 13 and 15 support a bobbin 17 which extends between them.

The bobbin 17 is a one piece, integrally molded unit made of a material such as glass filled nylon. It comprises a tube or sleeve 18 with a cylindrical outer surface 19 and a circular inner bore or well 19*a* and two end flanges 21 and 23. The bobbin 17 supports a winding or coil 25 placed around the tube 19 between the flanges 21 and 23 and covered by an insulative shell or wrapping 27, e.g., insulating tape. It also receives a plunger 31 in its bore 19*a*.

Figure 6:
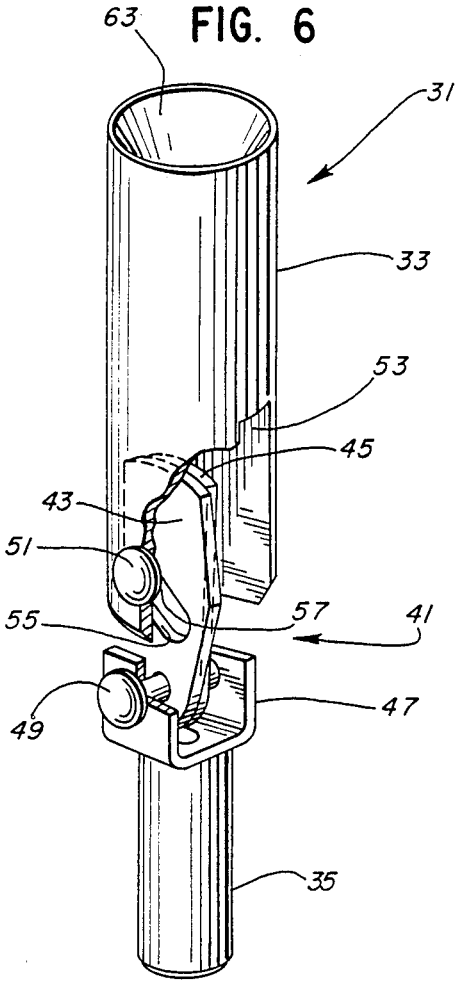
FIG. 6 is a partially cut away perspective view of the plunger of the solenoid device of the present invention.

The plunger 31 (shown separately in FIG. 6) includes a first segment 33 which is a metal rod or bar with a circular cross section corresponding to the cross section of the bore 19*a* and sized for a close sliding fit in the bore. This first segment 33 is a solid piece of highly magnetic permeable material. Accordingly, magnetic flux generated by the coil 25 moves the first member 33 axially within the bore 19*a*.

The plunger 31 also includes a second segment 35 which is also a rod or bar formed of metal or any other suitable material of high strength and rigidity. In the illustrated construction, this second segment 35 serves as a latching member and engages a corresponding member 37 of a locking mechanism. It drops into a recess 39 of the member 37 to place the mechanism in a lock mode.

For connecting the first and second segments together, the plunger 31 further includes a linkage 41. This linkage 41 includes two wing members 43 and 45 made from any suitable wear-resistant and magnetically impermeable material. A yoke 47 is staked or otherwise secured to the second segment 35. A pin 49 which extends through openings in the legs of the yoke 47 and in the bottom of wing members 43 and 45 pivotally mounts these two pivoting link or wing members 43 and 45 to the second segment 35. Another pin 51 slideably secures the two pivoting wings 43 and 45 to the first member 33. The pin 51 extends between the legs of a yoke portion 53 formed into the bottom of the first segment 33 and through an opening 55 in the wing member 43 and an opening 57 in the wing member 45. The yoke 47 and the pins 49 and 51 are made from brass or any other suitable wear-resistant and magnetically impermeable material.

Alternatively, a separate yoke structure similar to the yoke 47 may replace the yoke portion 53 of the first segment 33. Moreover, rather than having a separate yoke structure 47 to pivotally mount the wings 43 and 45 to the second plunger segment 35, the plunger may have a second segment with its top formed into a yoke similar to the yoke portion 53 of the first segment 33.

In addition to serving as a connection between the first and second plunger segments, the linkage prevents movement of the plunger 31 into the bore 19*a* past a predetermined point. Thus, it prevents the second segment 35 from moving out of locking engagement. The opening 55 in the wing member 43 and the opening 57 in the wing member 45 are elongate openings sized to allow pin 51 to slide along their length from one end to another. The opposite end points of these two elongate openings define the two limits of pivoting movement of wing members 43 and 45. When the wing members lie in the closed position shown in FIG. 2, the openings 55 and 57 slope downward of the pin 51.

Upon application of a compressive force to the plunger 31, the pin 51 moves at the opposite ends of the openings 55 and 57, and the linkage 41 assumes the position shown in FIG. 1. In this position the openings 55 and 57 slope upward of the pin 51. The angle of inclination of openings 55 and 57, or more particularly of their sides, may vary depending on the extent of the pivoting motion desired. In any event, the sides which engage the pin in a camming action lie inclined to the longitudinal axis of the plunger, downwardly and outwardly of the respective wing, when the links or wings lie open (FIG. 1) as well as when closed (FIGS. 2 and 3).

In its movement in and out of bore 19*a*, the first plunger segment 33 engages a conical stop 61 disposed at the bottom of the bore 19*a*. This conical stop 61 enters a corresponding conical opening 63 at the upper end of the plunger segment 33 and maintains alignment of the plunger in the bore 19*a*.

In operation, the solenoid device of the present invention 10, moves its plunger 31 axially between the position shown in FIG. 2 and the one shown in FIG. 3. In locking engagement (see FIG. 2) the second segment 35 of the plunger 31 engages the locking mechanism member 37. Although FIG. 2 shows the wing members 43 and 45 in closed position, these wings pivot outward to the position of FIG. 1 by a lost-motion toggle action as the first segment 33 of the plunger 31 presses downward on pin 51 under the force of gravity. The axial compressive force applied through pin 51 to the inclined cam edges of the slots automatically pivots the links to the open or "lock" position of FIG. 1.

When the user energizes the coil 25, the flux generated by the coil moves the plunger 31 upward to the location shown in FIG. 3. Since the force exerted by the magnetic flux on the plunger is a tension force, the wing members 43 and 45 move to a closed position as a result of a cam action of the pin 51 on the upper inclined edges of the slots 55 and 57. They remain in that position as the lower portion of the plunger retracts, as shown in FIG. 3.

When the user stops applying voltage to the coil 25, the plunger 31 again drops down into locking engagement with the member 37. In response to this movement, the wing members may open to their locking position of FIG. 2 by an opposite cam action of pin 51 on the lower inclined edges of the slots 55, 57. Accordingly, if someone attempts to jolt the plunger 31 upward, as by applying a blow or other upward impulse to the plunger segment 35, the wing members 43 and 45 pivot outward in response to the compressive force generated and engage the bobbin 17 circumjacent the bore 19*a* as shown in FIG. 1. By engaging the bobbin 17, the wing members 43, 45 prevent the plunger 31 from moving into the bore 19*a*, thus prevent the plunger segment 35 from moving out of the position shown in FIG. 2.

The plunger 31 usually lies along a vertical axis. However, under conditions of axial misalignment, i.e., when the longitudinal axis of the second plunger segment 35 lies to the right of the longitudinal axis of the first plunger segment 33, the wing members 43 and 45 may pivot in a manner shown in FIG. 4 to engage the bobbin 17 and prevent movement of the plunger 31 into the bore 19*a*. With this orientation, if the plunger 31 only included wing member 45, the linkage 41 could not stop the plunger 31 and prevent it from moving into the bore 19*a*. For the misalignment condition shown in FIG. 5, where the longitudinal axis of the second plunger segment 35 lies to the left of the longitudinal axis of the first plunger segment 33, the wing members 43 and 45 may pivot in the manner shown with the wing member 45 engaging the bobbin 17.

Figure 9:
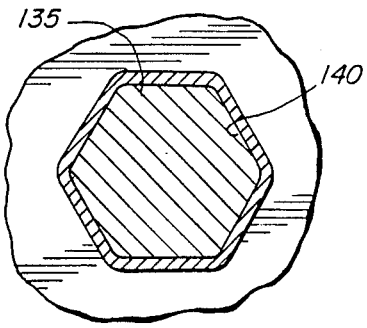
FIG. 9 is a sectional view taken along line 9—9 in FIG. 7.
Figure 8:
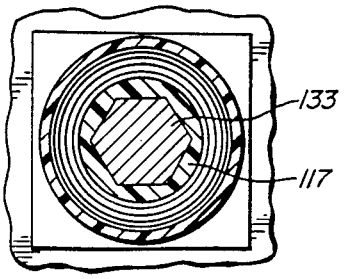
FIG. 8 is a sectional view taken along line 8—8 in FIG. 7.

In an alternative embodiment shown in FIGS. 7 through 9, the solenoid device of the present invention shown generally at 100 includes a plunger 131 having a first segment 133 with hexagonal cross-section which corresponds to a hexagonal cross-section of a bore 119*a* which extends through the center of the solenoid bobbin 117. The second plunger segment 135 also has a hexagonal cross-section; and it extends through an opening 140 in the locking mechanism housing 142 which has a corresponding hexagonal cross-section. This feature of the mating non-circular sections prevents the plunger segments 133 and 135 from rotating and moving out of axial alignment. Thus, the solenoid device of this construction only has one pivoting wing member 143 which pivots outward in response to compressive forces applied to the plunger 131. In moving outward the member 143 engages the bobbin 117 to prevent the plunger 131 from moving into bore 119*a* and the segment 135 from moving out of the locked position.

Thus, a solenoid device has been provided which meets the aforestated objects. The plunger of this device will move to precise, predetermined positions upon application of tension and compressive forces. The solenoid device has a simplified construction which minimizes the expensive manufacture and assembly and gives precise, uniform and reliable performance.

While the drawings and the text illustrate two embodiments of the present invention, one should understand, of course, that the invention is not limited to these embodiments. Those skilled in the art to which the invention pertains may make modifications and other embodiments employing the principals of this invention, particularly upon considering the foregoing teachings. The applicants, therefore, by the appended claims intend to cover any such modifications and other embodiments and to incorporate those features which constitute the essential features of this invention.

What is claimed is:

1. A solenoid device comprising: a bobbin defining an armature bore therein; a plunger extending into said bore and serving as an armature for said solenoid; coil means surrounding said bobbin for generating magnetic flux to move said plunger axially in said bore; and stop means disposed proximate said plunger for engagement by said plunger; said plunger including a main body portion and engaging means for extending transversely and outwardly of said plunger main body portion in response to compressive forces applied to said plunger to engage said stop means and to thereby prevent movement of said plunger inward of said bore.

2. The solenoid device of claim 1, wherein said main body portion of said plunger and said bore have noncircular complementary cross sections.

3. The solenoid device of claim 1, wherein said stop means is a portion of said bobbin circumjacent said bore.

4. A solenoid device comprising: a bobbin defining an armature bore therein; a plunger extending into said bore and serving as an armature of said solenoid; coil means surrounding said bobbin for generating magnetic flux to move said plunger axially in said bore; and stop means disposed proximate said plunger for engagement by said plunger; said plunger including a first segment formed out of material having high magnetic permeability and being movable axially in said bore by the magnetic flux generated by said coil means, a second segment, at least one linking member disposed between said first and second segments for connecting said first and second segments together, and mounting means for mounting said linking member to said first and second segments whereby said linking member pivots transversely and outwardly of said first segment in response to a compressive force applied to said plunger to engage said stop means and thereby to prevent said second segment from moving inward of said bore.

5. The solenoid device of claim 4, wherein said first segment of said plunger and said bore have noncircular complementary cross sections.

6. The solenoid device of claim 4, wherein said stop means is a portion of said bobbin circumjacent said bore.

7. The solenoid device of claim 4, wherein said mounting means includes an inclined cam slot in said linking member.

8. A plunger extending into an armature bore of a solenoid device having a stop disposed thereon, said plunger being moveable by magnetic flux generated by a coil means of said solenoid device, said plunger comprising: a first segment formed out of material having high magnetic permeability and being moveable axially in said bore by the magnetic flux generated by said coil means, a second segment, at least one linking member disposed between said first and second segments for connecting said first and second segments together, and mounting means for mounting said linking member to said first and second segments whereby said linking member pivots transversely and outwardly of said first segment in response to a compressive force applied to said plunger to engage said stop means and to thereby prevent said second segment from moving inward of said bore.

9. The solenoid device of claim 7, wherein said mounting means includes an inclined cam slot in said linking member.

10. The solenoid device of claim 1 wherein said engaging means includes a locking link movable outwardly of said plunger by a camming action in response to such compressive forces.

11. The solenoid device in claim 10 wherein said locking link is pivotally mounted on said plunger.

12. The solenoid device of claim 1 wherein said engaging means is of magnetically impermeable material.

* * * * *